US011390087B2

(12) United States Patent
Hayashi

(10) Patent No.: US 11,390,087 B2
(45) Date of Patent: Jul. 19, 2022

(54) LIQUID EJECTION HEAD

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 141 days.

(21) Appl. No.: 16/893,654

(22) Filed: Jun. 5, 2020

(65) Prior Publication Data

US 2020/0384775 A1 Dec. 10, 2020

(30) Foreign Application Priority Data

Jun. 10, 2019 (JP) ..... JP2019-107713

(51) Int. Cl.
*B41J 2/175* (2006.01)
*B41J 2/045* (2006.01)
*B41J 2/14* (2006.01)

(52) U.S. Cl.
CPC ..... *B41J 2/175* (2013.01); *B41J 2/04531* (2013.01); *B41J 2/14145* (2013.01); *B41J 2/14201* (2013.01); *B41J 2002/14306* (2013.01); *B41J 2002/14419* (2013.01); *B41J 2202/08* (2013.01)

(58) Field of Classification Search
CPC ..... B41J 2/04531; B41J 2/14145; B41J 2/14233; B41J 2/175; B41J 2/14201; B41J 2002/11; B41J 2002/14491; B41J 2002/14241; B41J 2202/08; B41J 2002/14306; B41J 2002/14419
See application file for complete search history.

(56) References Cited

U.S. PATENT DOCUMENTS

| | | | | |
|---|---|---|---|---|
| 8,870,353 | B2 * | 10/2014 | Watanabe | B41J 2/14274 347/70 |
| 10,093,102 | B2 * | 10/2018 | Kimura | B41J 2/04531 |
| 10,507,659 | B2 * | 12/2019 | Wang | B41J 2/14233 |
| 10,913,276 | B2 * | 2/2021 | Tanaka | B41J 2/16538 |
| 2018/0086084 | A1 | 3/2018 | Kimura | |

FOREIGN PATENT DOCUMENTS

JP 2018-051768 A 4/2018

* cited by examiner

*Primary Examiner* — An H Do
(74) *Attorney, Agent, or Firm* — Banner & Witcoff, Ltd.

(57) ABSTRACT

A liquid ejection head includes a supply channel structure and a heater. The supply channel structure has a supply channel configured to allow liquid to flow therefrom to ejection channels that are configured to lead liquid to nozzles aligned in a first direction. The heater is configured to heat liquid. Assuming that a side of the liquid ejection head, in which the nozzles are provided, is defined as a lower side of the liquid ejection head, the heater is disposed above the supply channel structure.

17 Claims, 8 Drawing Sheets

LIQUID EJECTION HEAD

CROSS-REFERENCE TO RELATED APPLICATION

This application claims priority from Japanese Patent Application No. 2019-107713 filed on Jun. 10, 2019, the content of which is incorporated herein by reference in its entirety.

TECHNICAL FIELD

Aspects of the disclosure relate to a liquid ejection head that ejects liquid such as ink and that is included in a liquid ejection apparatus.

BACKGROUND

Some known liquid ejection apparatus is configured to eject ink toward a medium such as a recording sheet from a liquid ejection head (hereinafter, simply referred to as the "head") to form an image on the medium. Such a head may include a heater that is configured to heat a supply channel structure that allows liquid to flow therethrough.

For example, some known head includes a channel structure, a supply channel structure, and heaters. The channel structure includes ejection channels that lead ink toward nozzles. The supply channel structure includes supply channels that allow ink to flow therefrom to the ejection channels. The heaters are configured to heat the supply channel structure. In such a known head, heaters and temperature sensors are fixed to an outer periphery of the supply channel structure using an adhesive.

In order to eject relatively high viscosity ink from nozzles effectively, ink may need to be heated to be at a temperature slightly higher than a room temperature (e.g., approximately 40 degrees Celsius) to cause ink to have a suitable viscosity. The known head is configured to apply heat to the supply channel structure using the heaters to heat ink in the supply channel structure.

SUMMARY

In the known head, the heaters may be fixed to the outer periphery, that is, a side surface, of the supply channel structure using an adhesive. Nevertheless, it may be difficult to attach the heaters to the side surface of the supply channel structure in fabrication of the head. Thus, the procedure for fabricating such a head may include complicated steps.

Accordingly, aspects of the disclosure provide a liquid ejection head that may include a heater for heating a supply channel structure, wherein the liquid ejection head may be fabricated without a complicated step.

In one or more aspects of the disclosure, a liquid ejection head may include a supply channel structure and a heater. The supply channel structure may have a supply channel configured to allow liquid to flow therefrom to ejection channels that may be configured to lead liquid to nozzles aligned in a first direction. The heater may be configured to heat liquid. Assuming that a side of the liquid ejection head, in which the nozzles are provided, is defined as a lower side of the liquid ejection head, the heater may be disposed above the supply channel structure.

According to this configuration, the heater may be disposed above the supply channel structure. Attaching a heater in such a manner may be easier than attaching a heater to a side surface of a supply channel structure, thereby avoiding complication of the fabrication procedure. Such a configuration may enable the heater to heat the supply channel via the upper surface of the supply channel structure, thereby heating liquid more effectively as compared with a head including a heater disposed on a side surface of a supply channel structure.

With such a configuration, the one or more aspects of the disclosure may thus provide a liquid ejection head that may include a heater for heating a supply channel structure, wherein the liquid ejection head may be fabricated without a complicated step.

DETAILED DESCRIPTION

Figure 1:
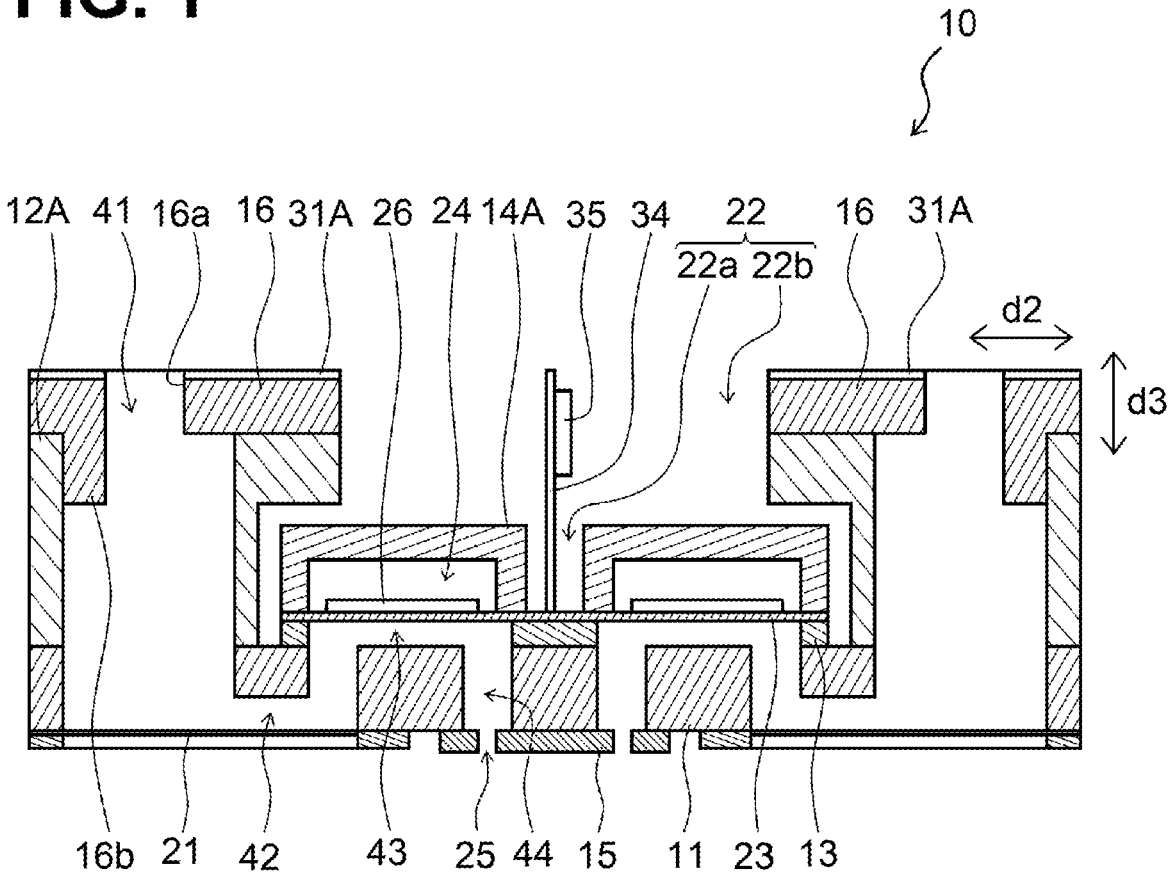
FIG. 1 is a schematic sectional view illustrating a general configuration of a liquid ejection head (hereinafter, simply referred to as the "head") according to a first illustrative embodiment of the disclosure.

Hereinafter, illustrative embodiments of the disclosure will be described with reference to the accompanying drawings. As used throughout this disclosure and the drawings, the same or similar elements will be indicated by common reference numerals or letters. Therefore, one of the same or similar elements may be described in detail, and description for the others may be omitted.

First Illustrative Embodiment

Configuration of Liquid Ejection Head

Figure 2:
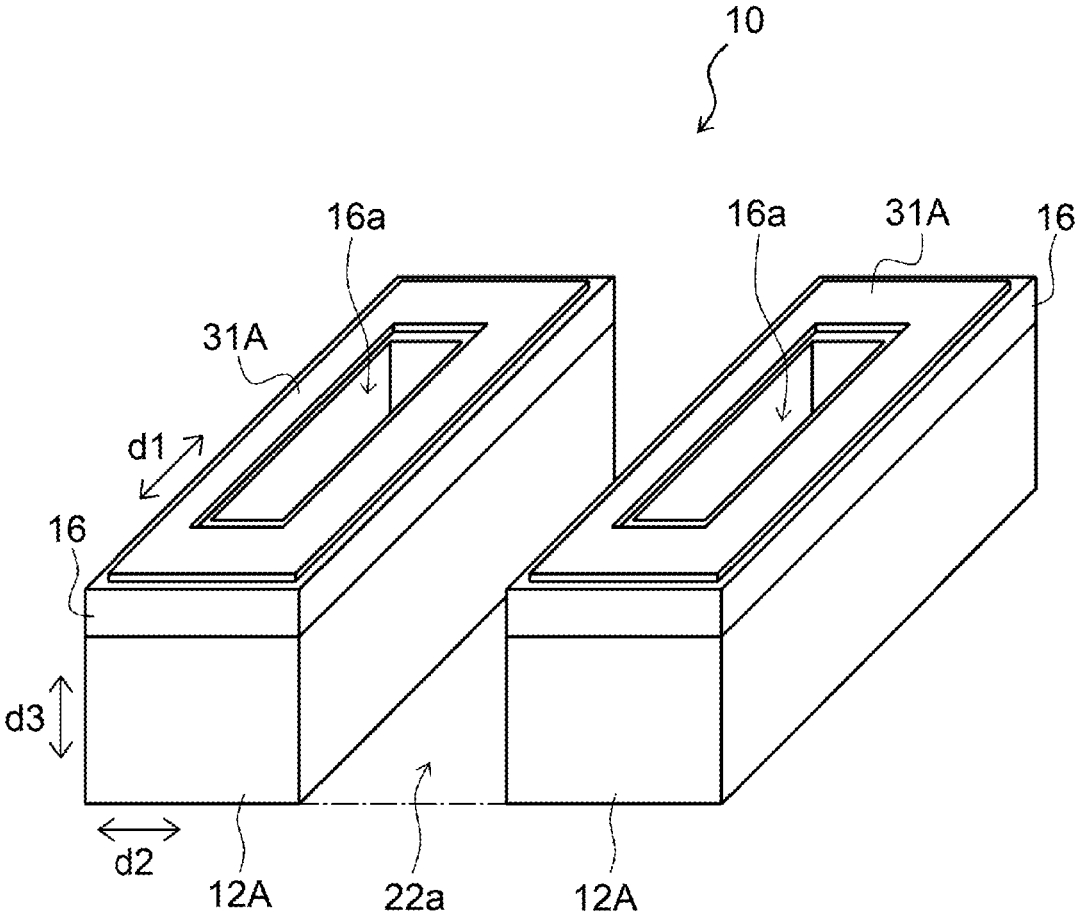
FIG. 2 is a schematic partial perspective view illustrating a configuration of an upper portion of the head of FIG. 1 according to the first illustrative embodiment of the disclosure.

Referring to FIGS. 1 and 2, a liquid ejection head 10 (hereinafter, simply referred to as the "head") according to a first illustrative embodiment will be described as one of examples of a head according to the disclosure. As illustrated in FIG. 1, the head 10 includes a channel structure 11, supply channel structures 12A, an actuator substrate 13, support substrates 14A, a nozzle substrate 15, thermal conductors 16, dampers 21, an elastic layer 23, piezoelectric elements 26, heaters 31A, a wiring substrate 34, and a drive IC 35.

The channel structure 11 may have a flat plate like shape. The channel structure 11 may have longer sides and shorter sides. A direction in which the longer sides of the channel structure 11 extend may be referred to as a longitudinal direction. The channel structure 11 is fixed to the supply channel structures 12A. The channel structure 11 has one surface and another surface opposite to each other. The actuator substrate 13 and the support substrates 14A are disposed between the channel structure 11 and the set of the supply channel structures 12A and are fixed to the one surface of the channel structure 11. The nozzle substrate 15 and the dampers 21 are fixed to the other surface of the channel structure 11. Each supply channel structure 12A has one surface and another surface opposite to each other. The other surface faces toward the channel structure 11. The thermal conductors 16 are disposed on the one surfaces of the respective supply channel structures 12A. The heaters 31A are disposed overlapping the respective thermal conductors 16.

FIG. 1 illustrates a cross section of the head 10 in a direction orthogonal to the longitudinal direction. The longitudinal direction may be defined as a length direction. A direction orthogonal to the longitudinal direction may be defined as a transverse direction. A direction orthogonal to the length direction and the transverse direction may be defined as an up-down direction. With reference to the directions, FIG. 1 illustrates a cross section of the head 10 in a plane extending both in the transverse direction and in the up-down direction. In FIG. 1, the head 10 is thus elongated in the transverse direction. In FIG. 1, the channel structure 11 is disposed below the supply channel structures 12A. In other words, the supply channel structures 12A are disposed above the channel structure 11. In the description below, directions of "up" and "down" may be defined with reference to the positional relationship between the channel structure 11 and the supply channel structures 12A.

In the head 10 illustrated in FIG. 1, the nozzle substrate 15 and the dampers 21 are joined to the lower surface of the channel structure 11, and the actuator substrate 13 and the support substrates 14A are joined to the upper surface of the channel structure 11 together with the supply channel structures 12A. The head 10 may basically have a symmetric structure with respect to the cross section of the head 10 in the transverse direction. Therefore, a configuration of one of the halves of the head 10 will be described and description for the other half will be omitted.

For describing the positional relationship in the head 10, the longitudinal direction, that is, the length direction, may be defined as a first direction regarded as a reference direction. The transverse direction may correspond to a right-left direction. The right-left direction may be defined as a second direction. The up-down direction may be defined as a third direction. The first direction is indicated by a double-headed arrow d1 in FIG. 2. The second direction is indicated by a double-headed arrow d2 in FIGS. 1 and 2. The third direction is indicated by a double-headed arrow d3 in FIGS. 1 and 2. For directions, basically the longitudinal direction may be used. In the description below, when not distinguishing the directions of "up", "down", "right", and "left", the transverse direction may be used. When distinguishing the directions of "up", "down", "right", and "left", the up-down direction or the right-left direction may be used.

The nozzle substrate 15 is disposed at the lower surface of the head 10. The nozzle substrate 15 has a plurality of nozzles 25 arranged along the longitudinal direction (e.g., the direction of the arrow d1 in FIG. 2). In the illustrative embodiment, the nozzles 25 are arranged in two nozzle rows in the nozzle substrate 15. Nevertheless, the number of nozzle rows is not limited to the specific example. A spacing (or pitch) between nozzles 25 in each nozzle row is not limited specifically. Any spacing may be adopted as long as the spacing corresponds to a density of dots to be formed on a recording sheet when the head 10 ejects liquid droplets (i.e., when the head 10 performs printing).

The nozzle substrate 15 is disposed at a middle portion of the lower surface of the head 10 in the right-left direction (e.g., the direction of the arrow d2 in FIG. 1). The dampers 21 are disposed at end portions of the lower surface of the head 10 in the right-left direction. The channel structure 11 has openings that may serve as ejection channels 42 that lead ink (e.g., liquid) toward the nozzles 25. The dampers 21 are disposed at the lower surface of the channel structure 11 to close the openings of the channel structure 11 to define the ejection channels 42.

The actuator substrate 13 is laminated on a middle portion of the upper surface of the channel structure 11 in the right-left direction. The elastic layer 23 is laminated on an upper surface of the actuator substrate 13. The support substrates (e.g., protection substrates) 14A are laminated on an upper surface of the elastic layer 23. Each support substrate 14A has a cavity 24. The cavities 24 may be recesses defined in lower surfaces of the respective support substrates 14A. The elastic layer 23 is disposed at the lower surfaces of the support substrates 14A to close the cavities 24. The piezoelectric elements 26 are disposed in the cavities 24. In other words, each support substrate 14A has a recess at a portion corresponding to corresponding ones of the piezoelectric elements 26. Each recess may have an appropriate size that may allow driving of the corresponding piezoelectric elements 26. The recesses may serve as the cavities 24. The piezoelectric elements 26 are disposed on the upper surface of the elastic layer 23. Thus, the piezoelectric elements 26 are disposed at a lower portion of a corresponding closed cavity 24.

The actuator substrate 13 has pressure chambers 43 that may be through holes. The pressure chambers 43 are disposed vertically below the corresponding cavities 24, that is, the respective corresponding piezoelectric elements 26. The elastic layer 23 defines upper surfaces of the respective pressure chambers 43. The channel structure 11 defines lower surfaces of the respective pressure chambers 43. The pressure chambers 43 are thus closed by the elastic layer 23 and the channel structure 11. The ejection channels 42 of the channel structure 11 are in communication with the respective corresponding pressure chambers 43. The channel structure 11 further includes nozzle communication channels 44 (e.g., descenders) that may be through holes. The nozzle communication channels 44 are in communication with the respective corresponding nozzles 25. The nozzle communication channels 44 are also in communication with the respective corresponding pressure chambers 43. As illustrated in FIG. 1, a pressure chamber 43 is in communication with a corresponding ejection channel 42 via one end portion of the lower surface of the pressure chamber 43 in the right-left direction. The pressure chamber 43 is also in communication with a nozzle communication channel 44 via the other end portion of the lower surface of the pressure chamber 43 in the right-left direction.

The pressure chambers 43 of the actuator substrate 13 are in fluid communication with the respective corresponding nozzles 25 defined in the nozzle substrate 15. In the first illustrative embodiment, the nozzles 25 of the nozzle substrate 15 are arranged in two rows along the longitudinal direction (e.g., the direction of the arrow d1 in FIG. 2). Thus, the pressure chambers 43 of the actuator substrate 13 are also arranged in two rows along the longitudinal direction to correspond to the respective corresponding nozzles of the nozzle rows. The piezoelectric elements 26 are disposed on the elastic layer 23 in a one-to-one correspondence with the pressure chambers 43. The piezoelectric elements 26 are thus arranged in two rows along the longitudinal direction to correspond to the nozzle rows and the respective pressure chambers 43.

As illustrated in FIG. 1, the supply channel structures 12A are disposed over the channel structure 11, the actuator substrate 13 disposed on the upper surface of the channel structure 11, and the support substrates 14A. Each supply channel structure 12A includes a supply channel 41 (e.g., a manifold) that is configured to allow ink (e.g., liquid) to flow therefrom to corresponding ejection channels 42 of the channel structure 11. The supply channels 41 are elongated in the up-down direction in the transverse cross section in FIG. 1. Each supply channel 41 is in communication with corresponding ones of the ejection channels 42 via its lower end. The supply channels 41 are connected to an ink cartridge (or ink tank). The supply channels 41 may be supplied with ink from the ink cartridge.

The head 10 has a hollow 22 including a first space 22*a* and a second space 22*b*. The supply channel structures 12A are spaced from each other in the right-left direction to define the first space 22*a* therebetween. The support substrates 14A are spaced from each other in the right-left direction to define the second space 22*b* therebetween. The first space 22*a* and the second space 22*b* are elongated along the longitudinal direction. The upper surface of the actuator substrate 13 is partially exposed through the second space 22*b*.

The supply channel structures 12A are separated from each other to define the first space 22*a* therebetween to allow the second space 22*b* to be exposed. With this arrangement, the supply channel structures 12A partially cover the channel structure 11, the actuator substrate 13, and the support substrates 14A. Such a configuration may thus allow the upper surface of the actuator substrate 13 to be partially exposed through the hollow 22 consisting of the first space 22*a* and the second space 22*b*.

An electrode trace extends on the upper surface of the actuator substrate 13 from each piezoelectric element 26. The electrode traces of the piezoelectric elements 26 are disposed in the second space 22*b*. The electrode traces of the piezoelectric elements 26 are connected to the wiring substrate 34. The drive IC 35 for driving the piezoelectric elements 26 is mounted on the wiring substrate 34. At least a portion of the wiring substrate 34 and the drive IC 35 are disposed in the hollow 22.

Each piezoelectric element 26 is configured to cause ink ejection from a corresponding nozzle 25. In response to driving of a piezoelectric element 26 by the drive IC 35, a corresponding portion of a vibration plate including the elastic layer 23 is warped to protrude toward a pressure chamber 43. This may cause ink (e.g., liquid) flow from the pressure chamber 43 to a corresponding nozzle 25 via a nozzle communication channel 44, thereby causing ejection of ink (e.g., liquid) from the corresponding nozzle 25. That is, the channel structure 11, the actuator substrate 13, the elastic layer 23, and the piezoelectric elements 26 constitute an actuator unit.

The heaters 31A are disposed at an upper portion of the head 10. The heaters 31A are configured to heat ink (or any liquid to be ejected from the head 10). According to the disclosure, a side of the head, in which the nozzles 25 are provided, may be defined as a lower side of the head. Thus, the head according to the disclosure has the nozzles 25 at the lower portion thereof. The heaters 31A are disposed at the upper portion of the head. The channel structure 11 that is in fluid communication with the nozzles 25 is disposed at the lower portion of the head 10. The supply channel structures 12A fixed to the channel structure 11 are disposed above the channel structure 11. Thus, the heaters 31A are disposed above the respective supply channel structures 12A.

In the head according to the disclosure, the heaters may be disposed above the respective supply channel structures 12A. In the first illustrative embodiment, as illustrated in FIGS. 1 and 2, the supply channel structures 12A are disposed on opposite sides of the hollow 22 (e.g., the first space 22*a*) in the longitudinal direction. That is, one of the supply channel structures 12A is disposed on one side with respect to the right-left direction and the other of the supply channel structures 12*a* is disposed on the other side with respect to the right-left direction. The supply channel structures 12A include the supply channels 41 (e.g., the manifolds), respectively, defined therein. The heaters 31A are disposed above the respective supply channel structures 12A in order to heat ink in the supply channels 41.

Hereinafter, one of the halves of the head 10 will be described. In the description below, plural same components have the same or similar configuration and function in the same or similar manner to each other. Therefore, one of the plural same components will be described in detail, and a description for the others will be omitted. In the first illustrative embodiment, the thermal conductor 16 is disposed on the upper surface of the supply channel structure 12A and the heater 31A is disposed on an upper surface of the thermal conductor 16. Nevertheless, in other embodiments, for example, the heater 31A may be disposed on the upper surface of the supply channel structure 12A. While the thermal conductor 16 may have a plate like shape that may be substantially the same shape as the upper surface of the supply channel structure 12A, the thermal conductor 16 may need to be made of material having a higher thermal conductivity than material used for the supply channel structure 12A.

As illustrated in FIGS. 1 and 2, the thermal conductor 16 has an opening 16*a* that is in fluid communication with the supply channel 41. As illustrated in FIG. 2, the opening 16*a* is elongated in the longitudinal direction of the supply channel structure 12A (e.g., the head 10). One or more temperature sensors such as thermistors may be disposed at a side surface of the head 10.

In the head 10 having the above configuration, the supply channel 41 (e.g., the manifold) of the supply channel structure 12A may be supplied with ink from the ink cartridge. The supply channel 41 is in communication with the ejection channels 42 of the channel structure 11. The ejection channels 42 are in communication with respective corresponding ones of the pressure chambers 43 arranged in the longitudinal direction. The nozzle communication channels 44 of the channel structure 11 and the nozzles 25 of the nozzle substrate 15 are arranged in the longitudinal direction. The pressure chambers 43 are in communication with the respective corresponding nozzles 25 of the nozzle substrate 15 via the respective corresponding nozzle communication channels 44. Such a configuration may thus allow ink supplied to the supply channel 41 to flow therefrom to the pressure chambers 43 via the ejection channels 42.

The piezoelectric elements 26 are disposed at the upper surfaces of the respective corresponding pressure chambers 43. The vibration plate including the elastic layer 23 is disposed to extend over the upper surfaces of the pressure chambers 43. With such a configuration, as a piezoelectric element 26 is driven, ink flows from a pressure chamber 43 to a nozzle 25 via a nozzle communication channel 44, thereby causing ejection of ink to the outside of the head 10. While ink flows from the pressure chamber 43 to the nozzle, the heater 31A heats the supply channel structure 12A from the upper surface side, thereby heating the supply channel 41 (e.g., the manifold) via the upper surface of the supply channel structure 12A. The heater 31A is configured to be driven by control of a controller. More specifically, for example, the controller controls driving of the heater 31A based on at least temperature measured by the temperature sensor.

The configuration of the head 10 is not limited to the specific example such as the head 10 including the channel structure 11, the supply channel structures 12A, the actuator substrate 13, the support substrates 14A, the nozzle substrate 15, the thermal conductors 16, the dampers 21, the elastic layer 23, the piezoelectric elements 26, and the heaters 31A. In other embodiments, a head having any known configuration may be adopted.

The channel structure 11 may be a substrate made of, for example, inorganic material. In the first illustrative embodiment, for example, the channel structure 11 may be a silicon substrate. The ejection channels 42 and the nozzle communication channels 44 of the channel structure 11 may be formed by known anisotropic etching or half etching. The supply channel structure 12A may be made of, for example, known resin material. In the first illustrative embodiment, for example, the supply channel structure 12A may be made of ABS resin. In another example, the supply channel structure 12A may be made of inorganic material instead of resin material. Examples of the inorganic material include alumina ($Al_2O_3$).

The actuator substrate 13 may be a substrate made of, for example, inorganic material. In the first illustrative embodiment, for example, the actuator substrate 13 may be a silicon substrate. The actuator substrate 13 has a plurality of pressure chambers 43 formed by, for example, anisotropic etching. The pressure chambers 43 correspond to the respective corresponding nozzles 25 defined in the nozzle substrate 15.

The piezoelectric elements 26 are placed in the cavities 24 of the support substrates 14A and are thus protected by the support substrates 14A. That is, the support substrates 14A may be protection substrates for the piezoelectric elements 26. A material used for the support substrate 14A is not limited specifically. Examples of the material used for the support substrate 14A include inorganic materials such as glasses, ceramic materials, silicon monocrystal substrates, and metals, or organic materials such as known resin materials. The nozzle substrate 15 may be, for example, a silicon substrate made of inorganic material. The nozzles 25 arranged in rows (e.g., nozzle rows) may be formed in the nozzle substrate 15 by, for example, dry etching.

The thermal conductor 16 may be made of material having a relatively good thermal conductivity. More specifically, for example, the thermal conductor 16 may preferably be made of material having a higher thermal conductivity than the material used for the supply channel structure 12A. The material used for the supply channel structure 12A includes, for example, oxide-based inorganic material such as resin material or alumina. The material used for the thermal conductor 16 includes, for example, metal such as stainless steel (SUS), which may have a higher thermal conductivity than resin material and alumina. Using such metal as the material for the thermal conductor 16 may enable reasonable fabrication of the thermal conductor 16.

The damper 21 may be a film made of resin material (e.g., a damper film). For example, the damper 21 may be made of PPS resin. The elastic layer 23 may be made of elastic material. In the first illustrative embodiment, the elastic layer 23 may be, for example, a silicon dioxide layer having a thickness of approximately 1 μm. An insulating layer made of an insulating material is provided on the elastic layer 23. Examples of the insulating material include zirconium oxide. Nevertheless, the insulating material used for the insulating layer is not limited to the specific example. The piezoelectric elements 26 are disposed on the lamination of the elastic layer 23 and the insulating layer in a one-to-one correspondence with the pressure chambers 43.

The configuration of the piezoelectric elements 26 is not limited specifically. In the first illustrative embodiment, for example, the piezoelectric elements 26 have a configuration such that a lower electrode layer, a piezoelectric layer, and an upper electrode layer are laminated one above another on the lamination of the elastic layer 23 and the insulating layer and a pattern is provided by a known patterning method to correspond to the respective pressure chambers 43. The upper and lower electrode layers may be made of, for example, known metal. The piezoelectric layer may be made of, for example, known piezoelectric material including lead zirconate titanate (PZT). One of the upper and lower electrode layers may serve as a common electrode and the other may serve as individual electrodes. The elastic layer 23, the insulating layer, and the lower electrode layer may serve as a vibration plate configured to vibrate when the piezoelectric elements 26 are driven.

Electrode traces extend from the respective individual electrodes (e.g., the upper electrode layer or the lower electrode layer) on the insulating layer. The electrode traces are connected to the wiring substrate 34. A configuration of the wiring substrate 34 is not limited specifically. In the first illustrative embodiment, the wiring substrate 34 may be a known Chip on Film ("COF") substrate. The configuration of the drive IC 35 is not limited specifically. An integrated circuit or a drive element known in the field of liquid ejection head may be suitable. The drive IC 35 is configured to apply a drive signal (e.g., a drive voltage) to a particular portion between the upper electrode layer and the lower electrode layer of a particular piezoelectric element 26 to deform the piezoelectric element 26. This may thus cause the vibration plate including the lower electrode, the insulating layer, and the elastic layer 23 to vibrate.

The type of the temperature sensor such as a thermistor is not limited specifically. Any thermistor known in the field of liquid ejection head may be suitable. The configuration of the heater 31A is not limited specifically. Any heater known in the field of liquid ejection head may be suitable. In the first illustrative embodiment, for example, a known film heater or a known ceramic heater may be used as the heater 31A. The configuration of the controller is not limited specifically. For example, a microcomputer, a CPU of a microcontroller, or any controller having a known configuration including various storages may be used.

The fabrication method of the head 10 is not limited specifically. The head 10 may be fabricated using a known method in which the members such as the channel structure 11, the supply channel structures 12A, the actuator substrate 13, the support substrates 14A, the nozzle substrate 15, the dampers 21, the elastic layer 23, and the piezoelectric elements 26 may be fixed or joined to each other. The laminating order in which the members of the head 10 are fixed or joined to each other is not limited specifically. For example, the channel structure 11, the dampers 21, and the nozzle substrate 15 may be joined to fabricate a channel unit. The actuator substrate 13, the elastic layer 23, the piezoelectric elements 26, and the support substrates 14A may be joined to fabricate an actuator unit. Then, the channel unit and the actuator unit may be fixed to each other to fabricate the head 10.

The method for fixing or joining the members and/or the units to each other is not limited specifically. In one example, a known adhesive may be used. In another example, the members and/or the units may be fixed or joined to each other without using an adhesive. In this disclosure, in a case where the channel structure 11 and the supply channel structures 12A are fixed to each other using an adhesive, the adhesive may preferably have a higher thermal conductivity than the material used for the supply channel structures 12A.

In a case where the supply channel structures 12A are made of resin material, an adhesive having a higher thermal conductivity than the resin material used for the supply channel structures 12A may be used. More specifically, for example, in a case where the supply channel structures 12A are made of ABS resin material, an epoxy adhesive may be suitable. As compared with a silicone adhesive that may be one of typical adhesives, an epoxy adhesive tends to have a higher thermal conductivity than ABS resin. Thus, using such an epoxy adhesive may effectively reduce an occurrence of great difference in linear expansion coefficient between the channel structure 11 and the supply channel structures 12A at their joint surfaces. Consequently, the joint condition of the channel structure 11 and the supply channel structures 12A may be maintained in an appropriate condition.

Configuration of Heater and Thermal Conductor

Referring to FIGS. 1, 2, 3A, 3B, and 4, an example of the heater 31A and an example of the thermal conductor 16 of the head 10 will be described in detail.

The head according to the disclosure may include at least one heater that may serve as a liquid heating portion configured to heat ink (e.g., liquid). In the head according to the disclosure, the liquid heating portion may be disposed above the supply channel structure 12A. In the first illustrative embodiment, as illustrated in FIG. 1, the heater 31A is disposed on the upper surface of the thermal conductor 16 disposed on the upper surface of the supply channel structure 12A. That is, the heater 31A is disposed above the supply channel structure 12A. The thermal conductor 16 disposed between the upper surface of the supply channel structure 12A and the heater 31A may increase heat transferability from the heater 31A to the supply channel structure 12A.

Figure 3A:
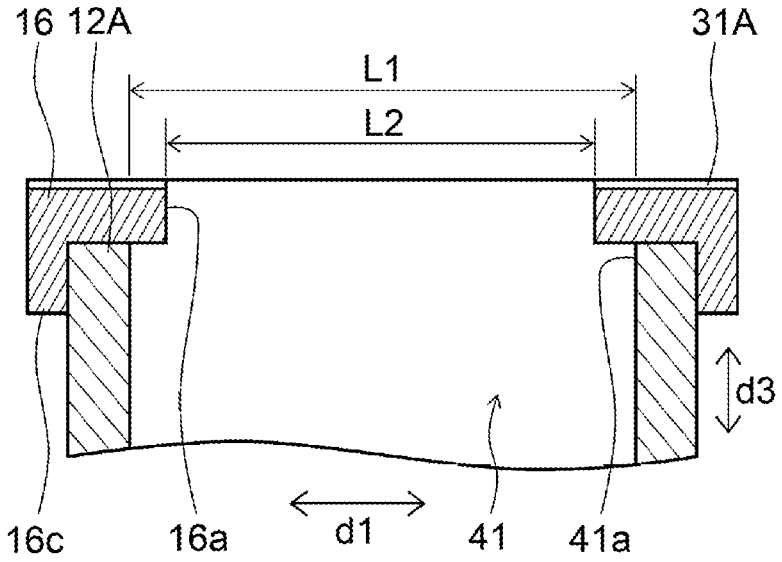
FIG. 3A is a schematic sectional view of a supply channel structure and a thermal conductor of the head of FIG. 1 in a plane with respect to a first direction according to the first illustrative embodiment of the disclosure, wherein a dimension of an opening of the supply channel structure and a dimension of an opening of the heat transfer portion are compared in the first direction.
Figure 3B:
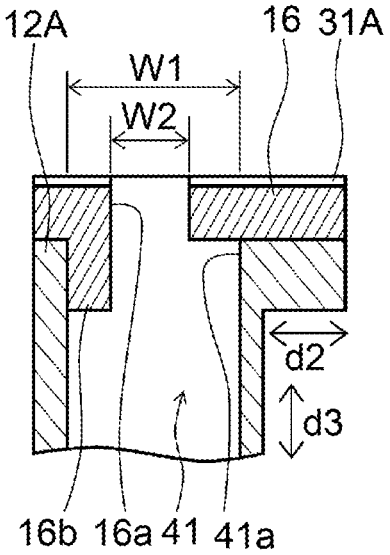
FIG. 3B is a schematic sectional view of the supply channel structure and the thermal conductor of the head of FIG. 1 in a plane with respect to a direction perpendicular to the first direction according to the first illustrative embodiment of the disclosure, wherein a dimension of the opening of the supply channel structure and a dimension of the opening of the heat transfer portion are compared in the direction perpendicular to the first direction.

The thermal conductor 16 may have a plate like shape that may cover the upper surface of the supply channel structure 12A. Nevertheless, the thermal conductor 16 may preferably have a shape that may cover another portion the supply channel structure 12A in addition to the upper surface of the supply channel structure 12A. As illustrated in FIG. 3A, the supply channel structure 12A has an opening 41*a* in its upper surface. The opening 41*a* is in communication with the supply channel 41. The opening 16*a* of the thermal conductor 16 may preferably have a smaller dimension than a dimension of the opening 41*a* of the supply channel structure 12A in the longitudinal direction (e.g., the first direction). As illustrated in FIGS. 1, 3A, and 3B, the thermal conductor 16 may preferably cover at least a portion of an inner circumferential surface of the opening 41*a* and/or a portion of a side surface of the supply channel structure 12A in addition to the upper surface of the supply channel structure 12A.

As illustrated in FIGS. 3A and 3B, the opening 41*a* of the supply channel structure 12A is in fluid communication with the supply channel 41 at the upper surface of the supply channel structure 12A and is elongated in the longitudinal direction. The opening 16*a* of the thermal conductor 16 is in fluid communication with the opening 41*a* of the supply channel structure 12A and is elongated in the longitudinal direction as with the opening 41*a*.

As illustrated in FIG. 3A, it is assumed that a dimension of the opening 41*a* in the longitudinal direction (e.g., a length) is L1 and a dimension of the opening 16*a* in the longitudinal direction (e.g., a length) is L2. In such a case, it is preferable that L1>L2. Values of the length L1 and the length L2 are not limited specifically. The length L1 and the length L2 may be assigned respective appropriate values in accordance with the specific configuration of the head 10. For example, the length L1 may be assigned a value of between 25 mm and 30 mm and length L2 may be assigned a value of between 20 mm and 25 mm while the relationship of L1>L2 is satisfied.

With this configuration, an area of the opening 16*a* of the thermal conductor 16 is smaller than an area of the opening 41*a* of the supply channel structure 12A. Thus, as illustrated in FIG. 3A, the inner circumference of the thermal conductor 16 protrudes inward to be positioned partially over the opening 41*a* of the supply channel structure 12A. Such a configuration may thus enable the thermal conductor 16 to be contacted directly to ink in the supply channel 41 and increase a contact area between the thermal conductor 16 and ink. Consequently, ink may be effectively heated via the thermal conductor 16.

As illustrated in FIG. 3B (and FIG. 1), a dimension of the opening 16*a* in a direction perpendicular to the longitudinal direction (e.g., the first direction) may preferably be smaller than a dimension of the opening 41*a* in the direction perpendicular to the longitudinal direction. The direction perpendicular to the longitudinal direction may correspond to the right-left direction (e.g., the second direction). As illustrated in FIG. 3B, it is assumed that a dimension of the opening 41*a* in the right-left direction (e.g., a width) is W1 and a dimension of the opening 16*a* in the right-left direction (e.g., a width) is W2. In such a case, it is preferable that W1>W2.

Values of the width W1 and the width W2 are not limited specifically. The width W1 and the width W2 may be assigned respective appropriate values in accordance with the specific configuration of the head 10. For example, the width W1 may be assigned a value of between 2 mm and 3 mm and the width W2 may be assigned a value of between 1 mm and 2 mm while the relationship of W1>W2 is satisfied. With this configuration, the area of the opening 16*a* of the thermal conductor 16 is smaller than the area of the opening 41*a* of the supply channel structure 12A. Such a configuration may thus enable the thermal conductor 16 to be contacted directly to ink in the supply channel 41. Consequently, ink may be effectively heated via the thermal conductor 16.

As illustrated in FIGS. 1 and 3B, the thermal conductor 16 may cover the upper surface of the supply channel structure 12A and at least a portion of the inner circumference of the supply channel 41. More specifically, for example, the thermal conductor 16 further includes an inner wall portion 16*b*. The inner wall portion 16*b* extends from the opening 16*a* of the thermal conductor 16 to the inside of the supply channel 41 through the opening 41*a* of the supply channel structure 12A. Such a configuration may thus enable increase of a heat transfer area of the thermal conductor 16 for transferring heat generated by the heater 31A and a particular portion of the thermal conductor 16 to be contacted directly to ink in the supply channel 41. Consequently, ink may be effectively heated via the thermal conductor 16.

In the example configuration illustrated in FIGS. 1 and 3B, the inner wall portion 16*b* may extend from one of the sides of an inner circumference defining the opening 16*a* in the right-left direction. Nevertheless, in other embodiments, for example, the inner wall portion 16*b* may extend each side of the inner circumference defining the opening 16*a* in the right-left direction. In another example, the inner wall portion 16*b* may extend continuously or intermittently along the opening 16*a* in the longitudinal direction.

As illustrated in FIG. 3A, the thermal conductor 16 may cover the upper surface and at least a particular portion of a side surface of the supply channel structure 12A. In FIG. 3A, the thermal conductor 16 further includes an outer wall portion 16*c* extending from its each end in the longitudinal direction. The outer wall portions 16*c* extend from the respective ends of the upper surface of the heat transfer portion 16 to cover upper portions of the side surfaces of the supply channel structure 12A. Such a configuration of the thermal conductor 16 may enable further increase of the heat transfer area of the thermal conductor 16 for transferring heat generated by the heater 31A. Consequently, ink in the supply channel 41 may be effectively heated via the thermal conductor 16.

In the example configuration illustrated in FIG. 3A, the outer wall portion 16*c* may extend from each end of the heat transfer portion 16 in the right-left direction. Nevertheless, in other embodiments, for example, the outer wall portion 16*c* may extend from one of the ends of the heat transfer portion 16 in the longitudinal direction or may extend from one or each of the ends of the heat transfer portion 16 in the right-left direction. In a case where the outer wall portion 16*c* extends from one or each end of the thermal conductor 16 in the right-left direction, the outer wall portion 16*c* may extend continuously or intermittently along the thermal conductor 16 in the longitudinal direction.

The heater 31A may have a shape that may cover the entirety of the upper surface of the supply channel structure 12A. Nevertheless, as illustrated in FIG. 2, the heater 31A may preferably cover a particular portion other than a central portion of the upper surface of the supply channel structure 12A. As described above, the supply channel structure 12A has the opening 41*a* at the central portion of the upper surface thereof. In a case where the thermal conductor 16 is disposed between the heater 31A and the supply channel structure 12A, the thermal conductor 16 has the opening 16*a* at its central portion. Thus, the heater 31A may have a hollow rectangular shape corresponding to the shape of the upper surface of the supply channel structure 12A, thereby covering the particular portion other than the central portion of the upper surface of the supply channel structure 12A. Thus, the heater 31A may heat the upper surface of the supply channel structure 12A intensively.

Figure 4:
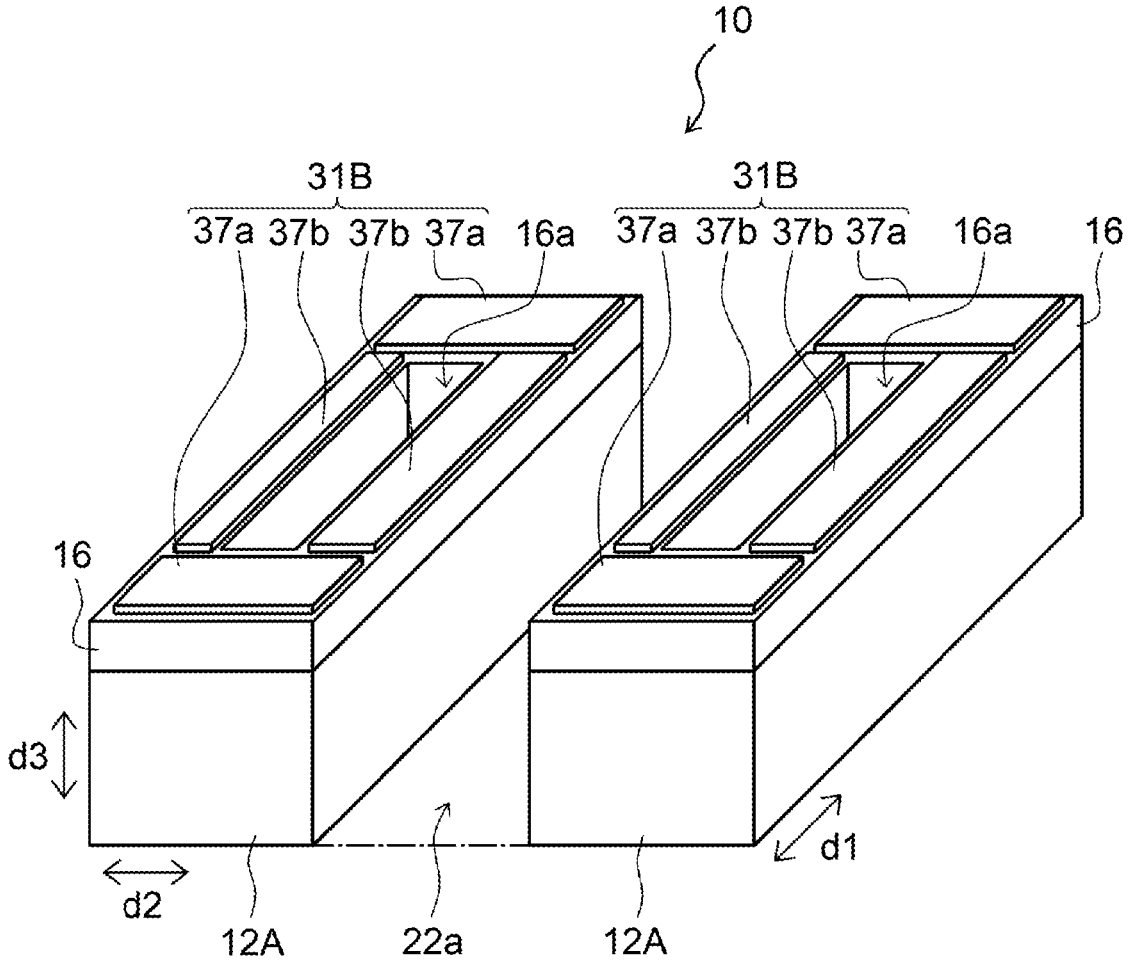
FIG. 4 is a schematic partial perspective view illustrating another configuration of the upper portion of the head of FIG. 1 according to the first illustrative embodiment of the disclosure.

In the example illustrated in FIG. 2, a single heater 31A may be used for covering the particular portion other than the central portion of the upper surface of the supply channel structure 12A. Nevertheless, in other embodiments, for example, as illustrated in FIG. 4, a heater 31B that may be a combined heater including a plurality of heaters may be used instead of the heater 31A. For example, the heater 31B includes a plurality of, for example, two wide heaters 37*a* and a plurality of, for example, two narrow heaters 37*b*. The wide heaters 37*a* are disposed at respective end portions of the supply channel structure 12A in the longitudinal direction. The narrow heaters 37*b* are disposed between the wide heaters 37*a* in the longitudinal direction and extend in parallel to each other. The wide heaters 37*a* and the narrow heaters 37*b* surround the opening 16*a*.

Each wide heater 37*a* has longer sides and shorter sides. Each wide heater 37*a* is disposed such that its longer sides extend along the right-left direction (e.g., the second direction). Each narrow heater 37*b* has longer sides and shorter sides. Each narrow heater 37*b* is disposed such that its longer sides extend along the longitudinal direction (e.g., the first direction). Thus, as with the heater 31A, the heater 31B may have a hollow rectangular shape corresponding to the shape of the upper surface of the supply channel structure 12A, thereby heating the particular portion other than the central portion of the upper surface of the supply channel structure 12A. The configuration of the heater 31B is not limited to the specific example of FIG. 4. In other embodiments, for example, the heater 31B may include three or less or five or more heaters.

Modifications

The head according to the disclosure may include the supply channel structures 12A and at least one heater. The heater may be disposed above one of the supply channel structures 12A. In the first illustrative embodiment, examples of the heater disposed above the supply channel structure 12A include the heater 31A that may be a single heater and the heater 31B that may a combined heater include a plurality of heaters. The heaters 31A and 31B may be disposed at the topmost portion of the head 10. Nevertheless, the configuration of the head according to the disclosure is not limited to the specific examples. Another member may be disposed above the heater 31A or 31B.

Figure 5:
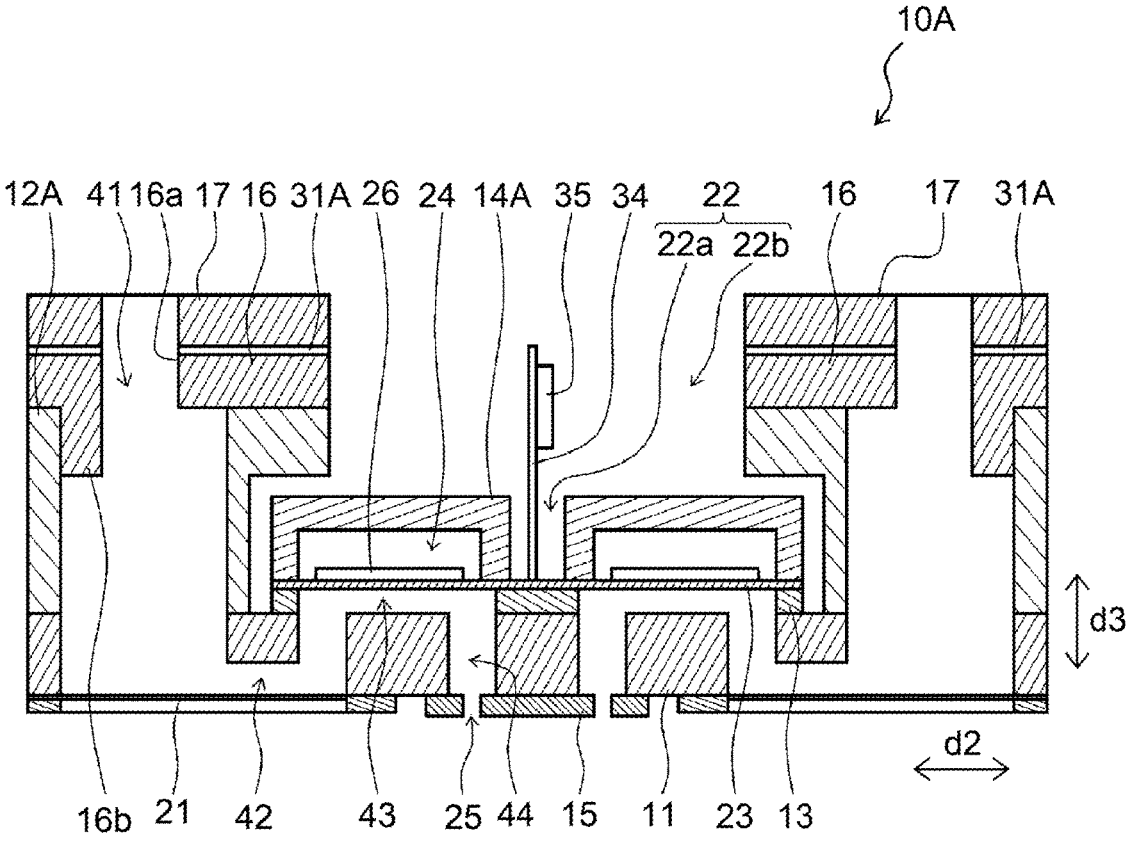
FIG. 5 is a schematic partial sectional view illustrating a configuration of a head according to a modification of the first illustrative embodiment of the disclosure.

For example, as illustrated in FIG. 5, a head 10A includes second thermal conductors 17. The second thermal conductors 17 are disposed above the respective heaters 31A. Both of the second thermal conductors 17 may have the same configuration to each other, and therefore, one of the second thermal conductors 17 will be described. The second thermal conductor 17 may be made of the same material (e.g., metal such as stainless steel) as the material used for the thermal conductor 16 (e.g., a first thermal conductor) disposed below the heater 31A. The head 10A illustrated in FIG. 5 has a similar configuration to the head 10 illustrated in FIG. 1 except that the head 10A includes the second thermal conductors 17. Therefore, a detailed description of the head 10A is omitted.

In this modification, the head 10A includes the second thermal conductor 17 that is disposed above the heater 31A and made of the same material as the material used for the thermal conductor 16. That is, the heater 31A that may be a film heater is sandwiched between the thermal conductors 16 and 17 that may be made of the same material. Such a configuration may thus reduce an occurrence of distortion in the head 10A due to difference in thermal expansion coefficient between the heater 31A and the thermal conductors 16 and 17 during heating by the heater 31A.

Figure 6:
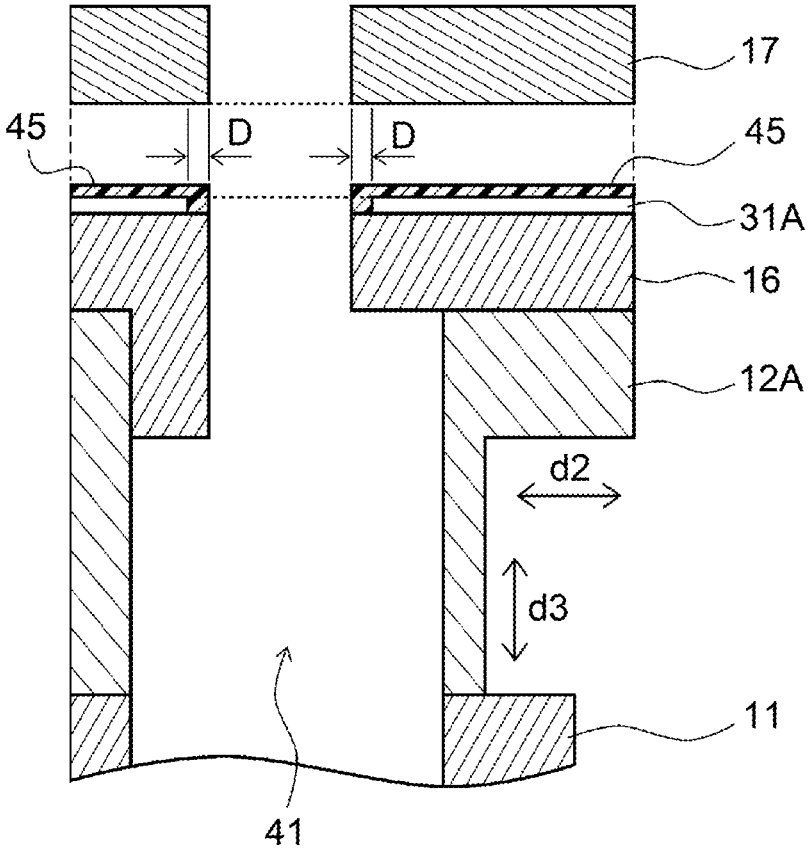
FIG. 6 is a schematic partial sectional view illustrating a specific configuration of the head of FIG. 5 according to the modification of the first illustrative embodiment of the disclosure.

A manner of fixing the second thermal conductor 17 to the upper surface of the heater 31A is not limited specifically. For example, as illustrated in FIG. 6, in the head 10A, the heater 31A is disposed on the thermal conductor 16 at an area other than an inner peripheral area of the thermal conductor 16. An adhesive layer 45 is provided on the inner peripheral area of the thermal conductor 16 and the entirety of the upper surface of the heater 31A to join the second thermal conductor 17 to the thermal conductor 16.

As illustrated in FIG. 6, the heater 31A disposed on the upper surface of the supply channel structure 12A recedes relative to the thermal conductor 16 by a distance D. Such an area may be referred to as an offset area. The offset area may provide an additional portion for applying adhesive around the heater 31A. Thus, the adhesive layer 45 may be formed on the offset area as well as the upper surface of the heater 31A. Thus, the thermal conductors 16 and 17 may be fixed to each other by adhesive. Consequently, the condition in which the heater 31A is sandwiched between the thermal conductors 16 and 17 may be maintained in an appropriate condition.

In the example illustrated in FIG. 6, the offset area may be provided at an inner peripheral edge portion of the upper surface of the thermal conductor 16 adjacent to the opening 16*a*. Nevertheless, in other embodiments, for example, an offset area may be provided at an outer peripheral edge portion or at both of the inner and outer peripheral edge portions of the upper surface of the thermal conductor 16. In a case where the heater 31B including the plurality of heaters is used, spaces between the heaters may serve as offset areas. A value of the distance D is not limited specifically. The distance D may be an offset amount of the offset area. The distance D may be assigned an appropriate value in accordance with the specific configuration of the head 10A. For example, the distance D may be assigned a value of 1 mm or greater.

In a case where a particular member is disposed above the heater 31A, the following adhesion method may be adopted. A position of the particular member is fixed using a jig while a portion for applying adhesive is left and the particular member is placed above the heater 31A leaving a gap (e.g., a space) therebetween. Then, an adhesive layer is formed at the portion for applying adhesive to maintain the position of the particular member. That is, the particular member and the heater 31A may be adhered to each other in the air. With this procedure, the particular member may be fixed to the thermal conductor 16 while a gap is left between the upper surface of the heater 31A and a lower surface of the particular member.

In the head according to the disclosure, the heater 31A may be disposed above the supply channel structure 12A (or on the upper surface of the supply channel structure 12A). When necessary, the head may include another heater disposed at another portion of the supply channel structure 12A. For example, as with the known head, the head 10, 10A may include a further heater disposed on a side surface of the supply channel structure 12A. In a case where the further heater is disposed on the side surface of the supply channel structure 12A in addition to the upper surface of the supply channel structure 12A, the supply channel 41 may be heated from two sides via the upper surface and side surface of the supply channel structure 12A. Thus, ink in the supply channel 41 may be heated appropriately.

Second Illustrative Embodiment

Figure 7:
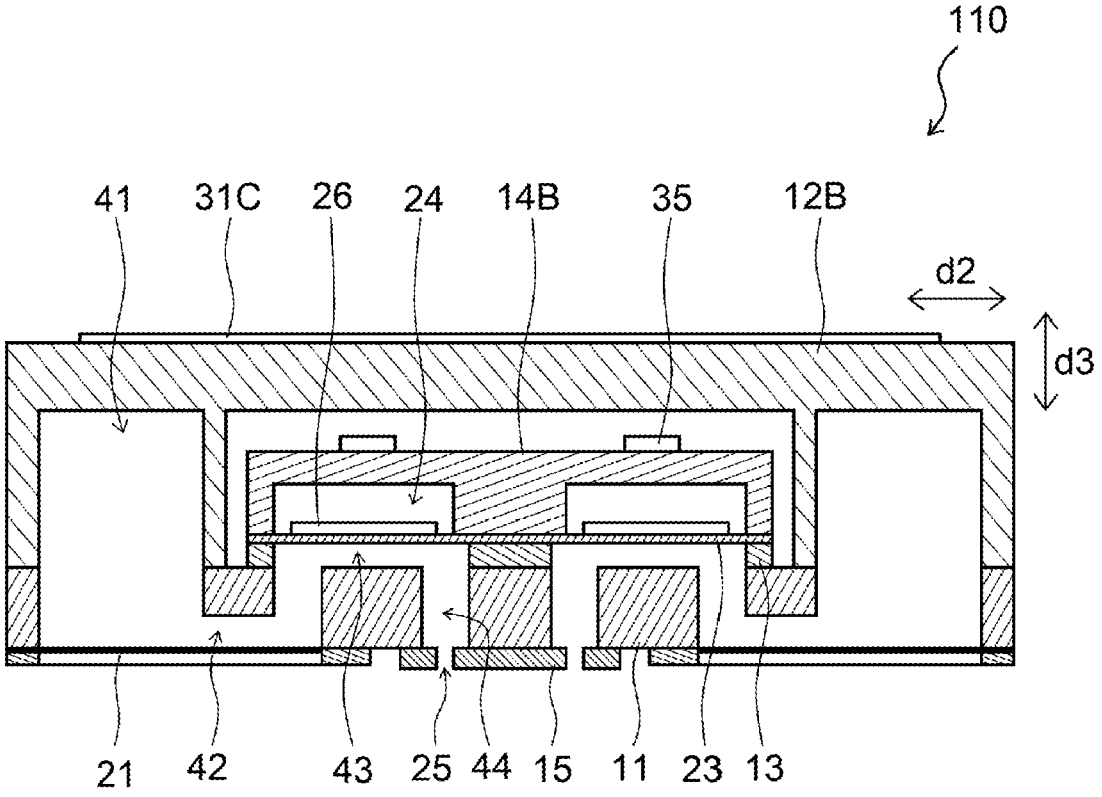
FIG. 7 is a schematic sectional view illustrating a general configuration of a head according to a second illustrative embodiment of the disclosure.
Figure 8:
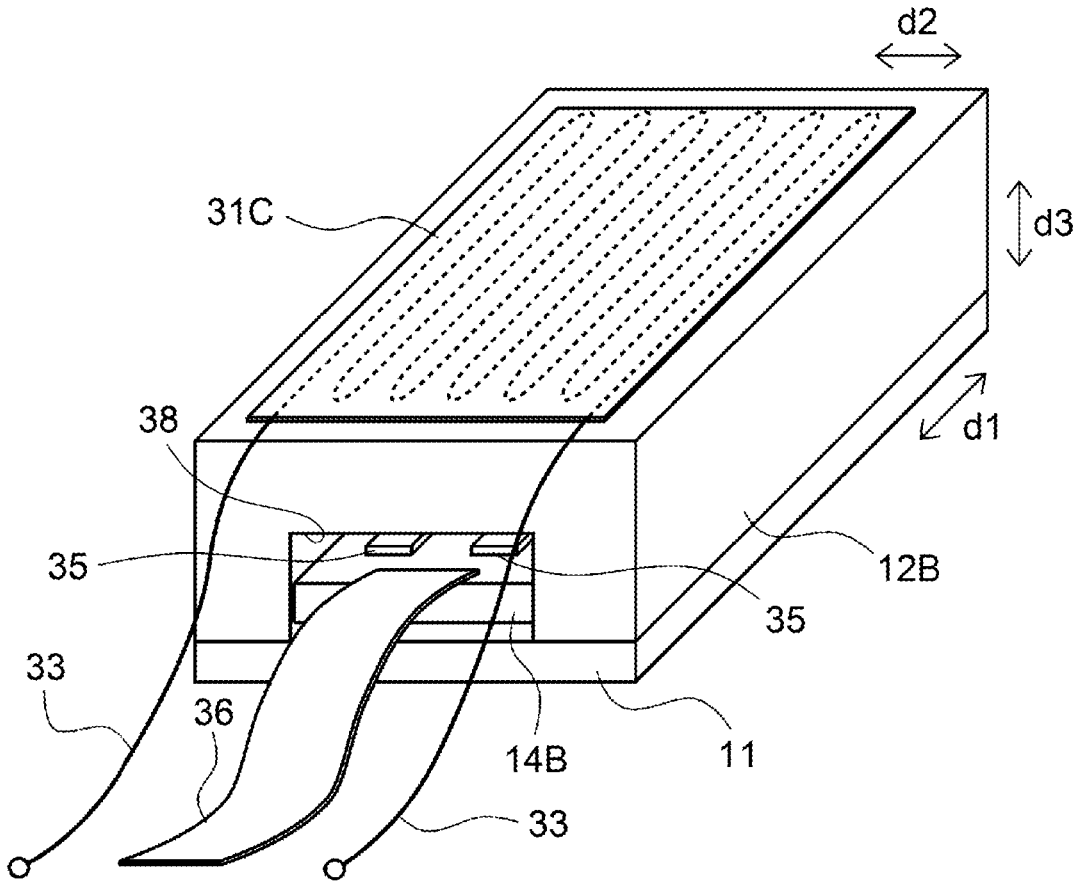
FIG. 8 is a schematic partial perspective view illustrating a configuration of an upper portion of the head of FIG. 7 according to the second illustrative embodiment of the disclosure.

In the head 10 according to the first illustrative embodiment, the heater 31A is disposed on the upper surface of the thermal conductor 16. Nevertheless, the head according to the disclosure is not limited to the specific example. In the head according to the disclosure, a heater may be disposed on an upper surface of a supply channel structure. Referring to FIGS. 7 and 8, an example of such a configuration will be described.

In a second illustrative embodiment, as illustrated in FIG. 7, a head 110 has a similar configuration to the head 10. Nevertheless, the head 110 includes a supply channel structure 12B, a support substrate 14B, and a heater 31C instead of the supply channel structures 12A, the support substrates 14A, and the heaters 31A. The supply channel structure 12B has a shape that may cover the entirety of an upper surface of the support substrate 14B that may be a protection substrate. The heater 31C is disposed on an upper surface of the supply channel structure 12B and extends over substantially the entirety of the upper surface of the supply channel structure 12B. As with the support substrates 14A of the first illustrative embodiment, the support substrate 14B has cavities 24. Each cavity 24 may be a recess defined in a lower surface of the support substrate 14B. An elastic layer 23 is disposed at the lower surface of the support substrate 14B to close the cavities 24. Piezoelectric elements 26 are disposed in the cavities 24.

In the first illustrative embodiment, the head 10 includes two support substrates 14A and has the second space 22*b* between the support substrates 14A in the right-left direction. Nevertheless, in the second illustrative embodiment, the head 110 includes a single support substrate 14B and thus might not have such a space. In the first illustrative embodiment, the head 10 further includes two supply channel structures 12A and has the first space 22*a* between the supply channel structures 12A in the right-left direction. The first space 22*a* and the second space 22*b* constitute the hollow 22. Such a configuration may thus allow the upper surface of the actuator substrate 13 to be partially exposed through the hollow 22. The wiring substrate 34 is connected to the exposed portion of the actuator substrate 13. The drive IC 35 is disposed at the wiring substrate 34.

Nevertheless, in the second illustrative embodiment, any portion of the actuator substrate 13 might not be allowed to be exposed. Thus, the head 110 includes through electrodes instead of the wiring substrate 34. The through electrodes penetrate the support substrate 14B. Each through electrode has one end connected to an electrode trace of a corresponding piezoelectric element 26 on the actuator substrate 13, and the other end connected to a corresponding drive IC 35. As illustrated in FIG. 7, the drive ICs 35 are disposed on the upper surface of the support substrate 14B (vertically above the respective cavities 24). The drive ICs 35 are configured to drive the piezoelectric elements 26.

In the second illustrative embodiment, although the head 110 does not have a hollow 22, the drive ICs 35 may be disposed on the upper surface of the support substrate 14B. Thus, the supply channel structure 12B may have a shape that may cover the entirety of the upper surface of the support substrate 14B and the heater 31C may be disposed on the upper surface of the supply channel structure 12B such that the heater 31C extends over substantially the entirety of the upper surface of the supply channel structure 12B. Such a configuration may thus enable the supply channel structure 12B to have a shape that may cover the entirety of the upper surface of the support substrate 14B. Thus, the supply channel structure 12B may provide a sufficient area for placing the heater 31C on its upper surface.

The entirety of the upper surface of the supply channel structure 12B may be heated by the single heater 31C, thereby effectively reducing an occurrence of temperature differences between the supply channels 41 when heated by the heater 31C, inconsistencies in density caused by temperature differences, and liquid ejection deficiency. As illustrated in FIG. 7, the drive ICs 35 disposed on the upper surface of the support substrate 14B and the portion of the supply channel structure 12B covering the support substrate 14B define a clearance therebetween. Such a clearance may thus insulate heat generated by the heater 31C disposed on the upper surface of the supply channel structure 12B.

The supply channel structure 12B may be made of resin material or inorganic material as with the supply channel structure 12A of the first illustrative embodiment. Nevertheless, in a case where the heater 31C is disposed on the upper surface of the supply channel structure 12B (e.g., the second illustrative embodiment), the supply channel structure 12B may preferably be made of inorganic material such as metal. The supply channel structure 12B made of inorganic material such as metal having a relatively high thermal conductivity may transfer heat generated by the heater 31C more effectively, thereby heating liquid in the supply channel 41 more effectively.

The entirety of the supply channel structure 12B might not necessarily be made of inorganic material such as metal. For example, a portion constituting the upper surface of the supply channel structure 12B (e.g., an upper portion of the supply channel structure 12B) may be made of inorganic material and the other portion of the supply channel structure 12B may be made of resin material or inorganic material other than metal. In a case where at least the upper portion of the supply channel structure 12B is made of inorganic material having a relatively high thermal conductivity and the heater 31C is disposed on the upper surface of the supply channel structure 12B, the heater 31C may heat the upper surface of the supply channel structure 12B directly, thereby heating the supply channel 41 appropriately.

The material used for the portion constituting the upper surface of the supply channel structure 12B might not necessarily be made of inorganic material such as metal and is not limited specifically as long as the material has a relatively good thermal conductivity. More specifically, for example, the thermal conductivity of the material may have a higher thermal conductivity than the material used for the dampers 21. The dampers 21 may be resin films. In a case where the material used for the portion constituting the upper surface of the supply channel structure 12B has a higher thermal conductivity than the material used for the dampers 21, a relative thermal conductivity of the supply channel structure 12B may be increased. Consequently, heat generated by the heater 31C disposed at the upper surface of the supply channel structure 12B may be transferred to the supply channel 41 more effectively.

In the second illustrative embodiment, as illustrated in FIG. 8, the head 110 further includes a flexible printed circuit board ("FPC") 36. The FPC 36 is electrically connected to the drive ICs 35. Input lines 33 are electrically connected to the heater 31C. As described above, the drive ICs 35 are disposed on the support substrate 14B and the head 110 might not have a hollow 22. Thus, the FPC 36 is not allowed to be routed to extend upward as with the head 10 of the first illustrative embodiment. The supply channel structure 12B has an opening 38 penetrating its one-side wall in the longitudinal direction. The FPC 36 extends out of the supply channel structure 12B from the drive ICs 35 toward the one side of the head 110 with respect to the longitudinal direction through the opening 38. Therefore, the heater 31C may preferably be disposed on the upper surface of the supply channel structure 12B such that the input lines 33 extending from the heater 31C extend toward the same side toward which the FPC 36 extends.

If the input lines 33 and the FPC 36 extend toward different sides of the head 110, a space for placing the input lines 33 and a space for placing the FPC 36 may be needed on respective sides of the head 110. In the second illustrative embodiment, as described above, the input lines 33 and the FPC 36 are routed to extend toward the same direction (e.g., toward the one side of the head 110 with respect to the longitudinal direction). In such a case, for example, as illustrated in FIG. 8, the input lines 33 of the heater 31C extend from the upper portion of the head 110 toward the one side of the head 110 and the FPC 36 extends from the lower portion of the head 110 toward the one side of the head 110 with respect to the longitudinal direction. That is, a space on one of the sides of the head 110 may be used as a common space for placing the input lines 33 and the FPC 36. As compared with a case where the input lines 33 and the FPC 36 extend toward different sides of the head 110, such a configuration may thus reduce interference of electrical components between the input lines 33 and other structures and between and the FPC 36 and other structures. Consequently, the head 110 may be compact in size. According to one or more aspects of the disclosure, a head may include a supply channel structure and a heater. The supply channel structure may have a supply channel configured to allow liquid to flow therefrom to ejection channels that may be configured to lead liquid to nozzles aligned in a first direction. The heater may be configured to heat liquid. Assuming that a side of the head, in which the nozzles may be provided, may be defined as a lower side of the liquid ejection head, the heater may be disposed above the supply channel structure. The heater may be disposed on the upper surface of the supply channel structure or on an upper surface of a first heat transfer portion. According to such a configuration, the heater may be disposed above the supply channel structure. Attaching the heater in such a manner may be easier than attaching a heater to a side surface of the supply channel structure, thereby avoiding complication of the fabrication procedure. Such a configuration may enable the heater to heat the supply channel via the upper surface of the supply channel structure, thereby heating liquid more effectively as compared with a head including a heater disposed on a side surface of a supply channel structure.

While the disclosure has been described in detail with reference to the specific embodiments thereof, these are merely examples, and various changes, arrangements and modifications may be applied therein without departing from the spirit and scope of the disclosure. The particular elements and features disclosed in the illustrative embodiments and the modifications or variations may be combined with each other in other ways without departing from the spirit and scope of the disclosure.

The disclosure may be suitable for liquid ejection heads of liquid ejection apparatuses configured to eject liquid such as ink.

What is claimed is:

1. A liquid ejection head comprising:

a nozzle substrate extending in a first direction and a second direction perpendicular to the first direction, the nozzle substrate comprising a plurality of nozzles aligned in the first direction;

a supply channel structure including a supply channel configured to allow liquid to flow therefrom to ejection channels that are configured to allow liquid to pass to the plurality of nozzles, the nozzle substrate being disposed on one side of the supply channel structure in a third direction perpendicular to the first direction and the second direction; and a heater disposed on the other side of the supply channel structure in the third direction, the heater configured to heat liquid.

2. The liquid ejection head according to claim 1, wherein the heater is disposed on an upper surface of the supply channel structure.

3. The liquid ejection head according to claim 1, further comprising a first thermal conductor disposed on an upper surface of the supply channel structure, wherein the heater is disposed on an upper surface of the first thermal conductor.

4. The liquid ejection head according to claim 3, wherein the first thermal conductor covers the upper surface of the supply channel structure and at least a portion of a side surface of the supply channel structure.

5. The liquid ejection head according to claim 3, further comprising a second thermal conductor disposed above the heater, the second thermal conductor made of the same material as the first thermal conductor.

6. The liquid ejection head according to claim 5, wherein the heater is disposed at an area other than an inner peripheral area of the first thermal conductor, and wherein the second thermal conductor is fixed to the first thermal conductor by an adhesive layer disposed at the inner peripheral area of the first thermal conductor.

7. The liquid ejection head according to claim 3, wherein the supply channel structure has a first opening that is in fluid communication with the supply channel and elongated in the first direction, wherein the first thermal conductor has a second opening that is in communication with the first opening and elongated in the first direction, and wherein the second opening has a smaller dimension in the first direction than a dimension of the first opening in the first direction.

8. The liquid ejection head according to claim 7, wherein the second opening has a smaller dimension than the first opening in a direction perpendicular to the first direction.

9. The liquid ejection head according to claim 7, wherein the first thermal conductor covers the upper surface of the supply channel structure and at least a portion of an inner circumference of the supply channel.

10. The liquid ejection head according to claim 7, wherein the heater covers a partial portion other than a central portion of the upper surface of the supply channel structure.

11. The liquid ejection head according to claim 3, wherein the first thermal conductor is made of metal.

12. The liquid ejection head according to claim 1, wherein the supply channel structure is made of inorganic material.

13. The liquid ejection head according to claim 1, further comprising a protection substrate protecting piezoelectric elements configured to cause liquid ejection from one or more of the nozzles, wherein the supply channel structure covers the entirety of an upper surface of the protection substrate, and wherein the heater extends over substantially the entirety of an upper surface of the supply channel structure.

14. The liquid ejection head according to claim 13, further comprising:

a drive circuit disposed on an upper surface of the protection substrate and configured to drive the piezoelectric elements; and a flexible printed circuit board (FPC) electrically connected to the drive circuit, wherein the heater includes an input line electrically connected to the heater, wherein the heater is disposed above the upper surface of the FPC and the input line extends from the heater toward the same side of the liquid ejection head toward which the FPC extends.

15. The liquid ejection head according to claim 14, wherein the drive circuit disposed on the upper surface of the protection substrate and a portion of the supply channel structure define a clearance therebetween.

16. The liquid ejection head according to claim 13, further comprising:

a channel structure including the ejection channels; and a damper disposed at the channel structure, wherein the upper surface of the supply channel structure is made of material having a higher thermal conductivity than material from which the damper is made.

17. The liquid ejection head according to claim 1, wherein the plurality of nozzles are disposed on a lower surface of the supply channel structure.

* * * * *